US011592000B2

(12) United States Patent
Leege et al.

(10) Patent No.: US 11,592,000 B2
(45) Date of Patent: Feb. 28, 2023

(54) SERVOLESS MOTOR

(71) Applicant: Danfoss Power Solutions, Inc., Ames, IA (US)

(72) Inventors: Steven Leege, Ames, IA (US); Stephen Frantz, Ames, IA (US); Jeffrey C. Hansell, Boone, IA (US)

(73) Assignee: Danfoss Power Solutions, Inc., Ames, IA (US)

( * ) Notice: Subject to any disclaimer, the term of this patent is extended or adjusted under 35 U.S.C. 154(b) by 393 days.

(21) Appl. No.: 16/050,001

(22) Filed: Jul. 31, 2018

(65) Prior Publication Data

US 2020/0040867 A1 Feb. 6, 2020

(51) Int. Cl.
*F03C 1/06* (2006.01)
*F03C 1/00* (2006.01)
(Continued)

(52) U.S. Cl.
CPC ..... *F03C 1/0636* (2013.01); *F03C 1/005* (2013.01); *F03C 1/08* (2013.01); *F04B 1/122* (2013.01); *F04B 1/20* (2013.01); *F04B 1/324* (2013.01)

(58) Field of Classification Search
CPC ..... F03C 1/005; F03C 1/0636; F03C 1/0639; F03C 1/655; F03C 1/668; F03C 1/0686; F03C 1/0694; F03C 1/08; F04B 1/122; F04B 1/146; F04B 1/29; F04B 1/2078; F04B 1/295; F04B 1/32; F04B 1/324; F04B 27/086; F04B 27/18; F04B 27/1818; F04B 27/1822; F04B 27/184; F04B 27/1863; F04B 27/1872; F04B 27/1877;
(Continued)

(56) References Cited

U.S. PATENT DOCUMENTS 3,727,521 A 4/1973 Reynolds
4,518,320 A * 5/1985 Goodell ..... F04B 49/08 417/217
(Continued)

FOREIGN PATENT DOCUMENTS

CN 102985691 A 3/2013
CN 106460807 A 2/2017
(Continued)

*Primary Examiner* — Dominick L Plakkoottam
*Assistant Examiner* — Charles W Nichols
(74) *Attorney, Agent, or Firm* — McCormick, Paulding & Huber PLLC

(57) ABSTRACT

A hydraulic piston unit including a rotational group for driving or being driven by a driving shaft, and having a tiltable displacement element for adjusting the displacement volume of the rotational group between a minimum or a maximum displacement, wherein, on t valve segment between a kidney-shaped inlet port and a kidney-shaped outlet port at respective dead end positions of reciprocally moveable working pistons first and second control ports are located in fluid connection with cylinder bores in the cylinder block, for controlling the position of the displacement element. The hydraulic piston unit further includes a control valve with a shiftable control valve spool fluidly connected via a high pressure port to a high pressure side of the hydraulic piston unit. The control valve spool is configured to conduct hydraulic fluid from the high pressure side to one of the first or the second control port.

13 Claims, 5 Drawing Sheets

(51) Int. Cl.

| | |
|---|---|
| ***F03C 1/08*** | (2006.01) |
| ***F04B 1/20*** | (2020.01) |
| ***F04B 1/32*** | (2020.01) |
| ***F04B 1/12*** | (2020.01) |
| ***F04B 1/122*** | (2020.01) |
| ***F04B 1/324*** | (2020.01) |

(58) Field of Classification Search
CPC ..... F04B 27/22; F04B 1/20; F04B 1/2042; F04B 49/002; F04B 49/22; F15B 15/14; F15B 15/20
See application file for complete search history.

(56) References Cited

U.S. PATENT DOCUMENTS

| | | | | |
|---|---|---|---|---|
| 4,918,918 | A * | 4/1990 | Miki | F04B 1/324 60/487 |
| 5,554,007 | A * | 9/1996 | Watts | F04B 1/324 417/222.1 |
| 2002/0157390 | A1 | 10/2002 | Hashimoto et al. | |
| 2008/0092967 | A1 * | 4/2008 | Stretch | F15B 13/0401 137/625.64 |

FOREIGN PATENT DOCUMENTS

| | | | |
|---|---|---|---|
| DE | 2217891 | A1 | 10/1972 |
| DE | 3783912 | T2 | 7/1993 |
| DE | 19538494 | A1 | 4/1996 |
| GB | 1 361 591 | A | 7/1974 |
| JP | 58176480 | A | 10/1983 |
| JP | 06117358 | A | 4/1994 |

* cited by examiner

SERVOLESS MOTOR

TECHNICAL FIELD

The present invention relates to hydraulic piston units having a displacement element for adjusting the displacement volume of the hydraulic unit. The invention relates in particular to hydraulic axial piston units of the swashplate and the bent axis construction type. However, the invention is applicable also on hydraulic radial piston units or vane pumps and motors. In the sense of the invention the term hydraulic piston unit covers hydraulic piston pumps as well as hydraulic piston motors. In a particular embodiment the invention relates to two position hydraulic axial piston units in which the displacement element can be positioned between two end positions for adjusting the displacement volume of the hydraulic axial piston unit to a maximum or minimum. Even though the invention is described with example of axial piston units in concrete with axial piston units of the swash plate construction type, the given examples are transferable by a person with skills in the relevant to all above mentioned types of hydraulic piston units.

BACKGROUND

In the state of the art, the displacement volume of hydraulic piston units is usually adjusted by the help of a servo unit having a servo cylinder and a movable servo piston, the position of which in the servo cylinder ultimately determines the displacement volume of the rotational group inside the hydraulic piston unit. Such a servo unit constitutes a separate assembly group, especially in two position hydraulic piston units, which causes increased costs and consumes construction space. Furthermore, such a servo unit is subjected to wear or other possible failures that may lead to inoperability of the whole hydraulic piston unit. Furthermore, every cylinder piston unit shows a certain leakage and, therefore, so does such a servo unit as well.

SUMMARY

Therefore it is object of the present disclosure to simplify adjusting and control means of the displacement volume of hydraulic piston units in order to overcome the deficiencies of state of the art. Thereby the inventive hydraulic piston units should comprise fewer parts for carrying out control of the displacement volume. The hydraulic piston unit should be easier and more economic to manufacture, in particular more simple in assembling the same.

The object of the invention is solved by a hydraulic piston unit having a rotational group for driving or being driven by a driving shaft. The hydraulic piston unit further comprise a displacement element being tiltable with respect to a rotational axis of the driving shaft between a first end position and a second end position. According to the angle of tilt of the displacement unit the displacement volume of the rotational group is adjusted between a maximum or a minimum displacement volume. Within a cylinder block working pistons are mounted reciprocally movable in cylinder bores for conveying hydraulic fluid from a kidney-shaped inlet port to a kidney-shaped outlet port of a valve segment. In the sense of the invention the rotational group comprises at least the cylinder block with the reciprocally movable working pistons therein as well as the driving or driven shaft and, at the lower end of the cylinder block, a valve segment with the before mentioned kidney-shaped inlet and outlet port. In case of a hydraulic piston unit of the swashplate construction type the swashplate also forms part of the rotational group as the piston heads are commonly fixed on the swashplate by the help of piston shoes. However, these piston shoes are designed to slide on the swashplate surface facing the cylinder block. Further, in case of these hydraulic piston units the swashplate and the valve segment are located on opposing sides of the cylinder block. The analogous is valid for hydraulic piston units of the bent axis construction type; however, in this case, the piston heads are fixed to the driving shaft in ball joints directly in order to allow the cylinder block to be bent with respect to the rotational axis of the driving shaft.

The inventive hydraulic piston unit includes, on the valve segment between the inlet port and the outlet port at the respective dead end positions of the reciprocally moveable working pistons, a first control port and a second control port are located with fluid connections with the cylinder bores. Such that the hydraulic fluid pressure difference between these two control ports and the hydraulic fluid pressure in the cylinder bores determines the tilt angle of the displacement element and finally the displacement volume of the hydraulic piston unit.

The inventive hydraulic piston unit further comprises a control valve with a shiftable control valve spool. The control valve is connected via a high pressure inlet port to the high pressure side of the hydraulic piston unit and is capable to conduct hydraulic fluid from the high pressure side to one of the first and second control port at the valve segment. Therewith one control port is fed at one dead end position of the working pistons with hydraulic fluid under high pressure, on the other control port at the other dead end position of the movement of the working pistons low pressure is present, for example tank or casing pressure. According to the invention high pressure acts on the working piston passing over the control port intending to push the working piston in direction outwardly of the cylinder bore. This forces the displacement element located at the opposite end of the cylinder block into either a deflected or perpendicular orientation with respect to the rotational axis of the cylinder block, thereby defining the displacement volume. Herewith, according to the invention, the working pistons are fulfilling the function of moving the displacement element, which in hydraulic piston units of the state of the art is done by via the above mentioned additional servo unit.

As it is common sense in the art for hydraulic piston units the displacement element is hold at least in its initial first end position preferably by an elastic force, preferably caused by a spring or the like, against a stop. In other angle positions can be obtained by a force balance between the deflecting forces—here performed by the working pistons as they pass the control ports at the respective upper and lower dead ends—and the elastic force acting in direction towards the initial first position. In particular with two position hydraulic piston units a second end position of the displacement element is provided by a second stop, against which the displacement element can abut in its maximum or minimum deflection/tilt angle. It should be readily understood that the displacement element can be positioned also in intermediate positions between the maximum and minimum angle of tilt, for instance by means of elastic or hydraulic forces varying with the angle of tilt.

For example, in one embodiment in which the initially set displacement volume of the hydraulic piston unit is at its minimum, i.e. the displacement element in its neutral or zero position and the tilt angle of the displacement element is equal to zero, the displacement element can be held in this position as long as the control spool of the control valve is not shifted out of its initial position, in which hydraulic fluid and high-pressure is guided to the first control port. In this exemplary case the displacement volume of the hydraulic piston unit increases with the displacement of the control valve spool as the pressure conducted to the first control port on the valve segment is decreases and the pressure guided to the second control port increases with displacing the control valve spool. This will continue until hydraulic fluid under high-pressure is guided only to the second control port. In that moment, for this embodiment, the displacement element is at its maximum displacement, i.e. at its maximum angle of tilt. However, it should be readily understood that this example can be carried out without difficulties also the other way around.

In essentially all hydraulic piston unit applications know in the art, in which a servo unit is used for adjusting the displacement volume, the inventive hydraulic piston unit can be applied instead. Hence all these possibilities are covered by the present disclosure too. However, in difference to the state of the art solutions, the invention provides for hydraulic piston units with fewer parts, as a servo unit is no longer necessary, and provides for the same reason for smaller hydraulic piston units which consume less construction space. Thereby the control of the displacement volume can be done merely by controlling the position of the control valve spool in the control valve which can be in a simple embodiment a 3-way/2-position valve.

As the invention only effects the manner in which the displacement element is positioned and controlled in its positioning the hydraulic piston units according to the invention can be operated in motor mode as well as in pump mode, including the associated propel and drag modes in case the inventive hydraulic piston unit is applied to a closed hydraulic circuit.

In a basic embodiment the inventive hydraulic piston unit is of the two position construction type, i.e. only minimum displacement and maximum displacement is selectable. In this case the control valve is also only a two position valve which either conducts hydraulic fluid to the first control port or to the second control port. In this case by switching the control valve from a first position to a second position and vice versa the hydraulic piston unit changes its displacement volume from maximum to minimum and vice versa. It should be readily understood that the control valve spool as well as the hydraulic piston unit can be adjusted in intermediate position too and over "zero" displacements of the displacement element are possible as well. Such that a maximum displacement can be as big in absolute value as a minimum displacement only the leading sign changes, i.e. the conveying direction or the propel mode changes to drag mode.

Therefore, according to the invention, the control valve can be a two position valve as well as a proportional valve. In case the control valve is a proportional valve the displacement of the rotational group is adjustable proportionally as well. Here the control of the control valve can be done preferably by actuator means commanded by a control unit. The control unit itself, for instance, monitors system parameters or receives inputs from an operator of a hydraulic propel application and send a corresponding signal to the actuator means in case the angle of tilt of the displacement element has to be changed or maintained, e.g. when a value for a system parameter is exceeded or underrun. Thereby the actuator means shift the control valve spool in an electro-mechanical, hydraulic, pneumatic way or in a combination of these possibilities. Examples for such electro-mechanical, hydraulic, or pneumatic means are known in the art. For example springs, solenoids, cylinder-piston—units, levers, electric or thermic relays and the like are exemplarily of such actuation means to actuate the control valve spool in order to maintain or change its position. Therefore all these common art possibilities of actuation on the control valve spool in combination with the inventive guidance of pressurized hydraulic fluid to the first and the second control port in the valve segment are covered by the present disclosure.

Furthermore, all these means for shifting the control valve spool can be controlled by means of a control unit which preferably is capable to command the before mentioned actuator means to act on the control valve spool. Thereby the control means can be a CPU, a microprocessor or the like which sends a corresponding signal to the actuator means for changing or holding the position of the shiftable control valve spool. Naturally the control unit receives input information from other components and/or, for instance, from the operator of a hydraulically driven vehicle, and transmits a corresponding signal to the actuator means. In another embodiment of the invention the control unit supervises system parameters and commands the actuator means to hold or to shift the control valve spool in case a system parameter is exceeded or underrun.

As mention already above the inventive hydraulic piston unit is applicable to open hydraulic circuits as well as to close hydraulic circuits with to conveying directions and/or the capability to operate in propel mode or drag mode. In case of implementing the inventive hydraulic piston unit in such a closed hydraulic circuit the inventive hydraulic piston unit preferably comprises a high pressure selecting valve which is fluidly connected to both pressure sides of the hydraulic piston unit and which is capable to supply hydraulic fluid from the high pressure side to a high pressure inlet port of the control valve. Such a high pressure selecting valve in a basic embodiment is in the form of a double check valve having two inlets and one outlet, wherein the inlet of the lower pressure side is closed by the check valve ball under the action of the high pressure. Such that in any operational condition it is ensured that hydraulic fluid under high-pressure is guided to the high-pressure inlet port of the control valve.

In a further preferred embodiment of the invention the control valve is also capable to conduct hydraulic fluid under low or lower pressure to the respective other control port on the valve segment which is not charged with hydraulic fluid under high pressure. Thereby the control valve is connected via a low pressure inlet port to the low pressure side of the hydraulic piston unit or to a charge pressure source, e.g. in form of a charge pump, or to another system pressure being lower than the high pressure level. In case the hydraulic piston unit is in implemented into a closed hydraulic circuit the control valve is fluidly connected to both pressure lines of the hydraulic circuit by means of a low pressure selecting valve, in order to conduct properly in both conveying directions hydraulic fluid under a lower pressure to the respective other control port not charged with high-pressure. This low pressure selecting valve can be performed, for instance, by a shifting valve with a shifting valve spool referenced on one side to the high pressure level and on the opposite side to a lower pressure level, which do not have to be the pressure level which is forwarded by the low pressure selecting valve.

In summary, with the inventive hydraulic piston unit a control method for adjusting the displacement volume at least of a two position hydraulic unit can be performed in a simplified manner, wherein a control valve spool is held in its initial position in which the control valve conducts hydraulic fluid from the high pressure side to one of a first or second control port located on the valve segment of the hydraulic piston unit at the respective dead end positions of the reciprocating working pistons, if the initial displacement volume of the inventive hydraulic piston unit is to be maintained, and the control valve spool is shifted by means of actuator means into a shifted position for supplying hydraulic fluid under high pressure to the respective other control port, if the initial displacement volume of the two position hydraulic unit has to be changed. As mentioned above the inventive control method is performed in a basic embodiment on two position hydraulic piston units, however it is applicable also on proportional adjustable hydraulic piston units in order to change the displacement volume of the rotational group proportionally.

Further preferably the control of the displacement volume of the rotational group of the inventive hydraulic piston unit is controlled via a control unit capable to command actuator means, which act on the control valve spool of the control valve. This control valve can be of the two position type or a proportional valve.

The inventive method for controlling the displacement volume of a hydraulic piston unit can also include the control of guidance of hydraulic fluid under low pressure which is conducted to the respective other control port on the valve segment not being charged by hydraulic fluid under high pressure. The inventive control method is applicable on hydraulic piston units in an open circuit as well as on hydraulic piston unit in a closed hydraulic circuit, where the inventive hydraulic piston unit can be operated in both rotational directions as well as in propel mode or in drag mode.

BRIEF DESCRIPTION OF THE DRAWINGS

Exemplary embodiments of the inventive hydraulic piston unit according to the present disclosure are shown in more detail in the enclosed drawings which do not limit the scope of the present disclosure. All features of the disclosed and illustrated embodiments may be combined in any desired combination with one another within the scope of the present invention. For this purpose it is shown in.

DETAILED DESCRIPTION

Figure 1:
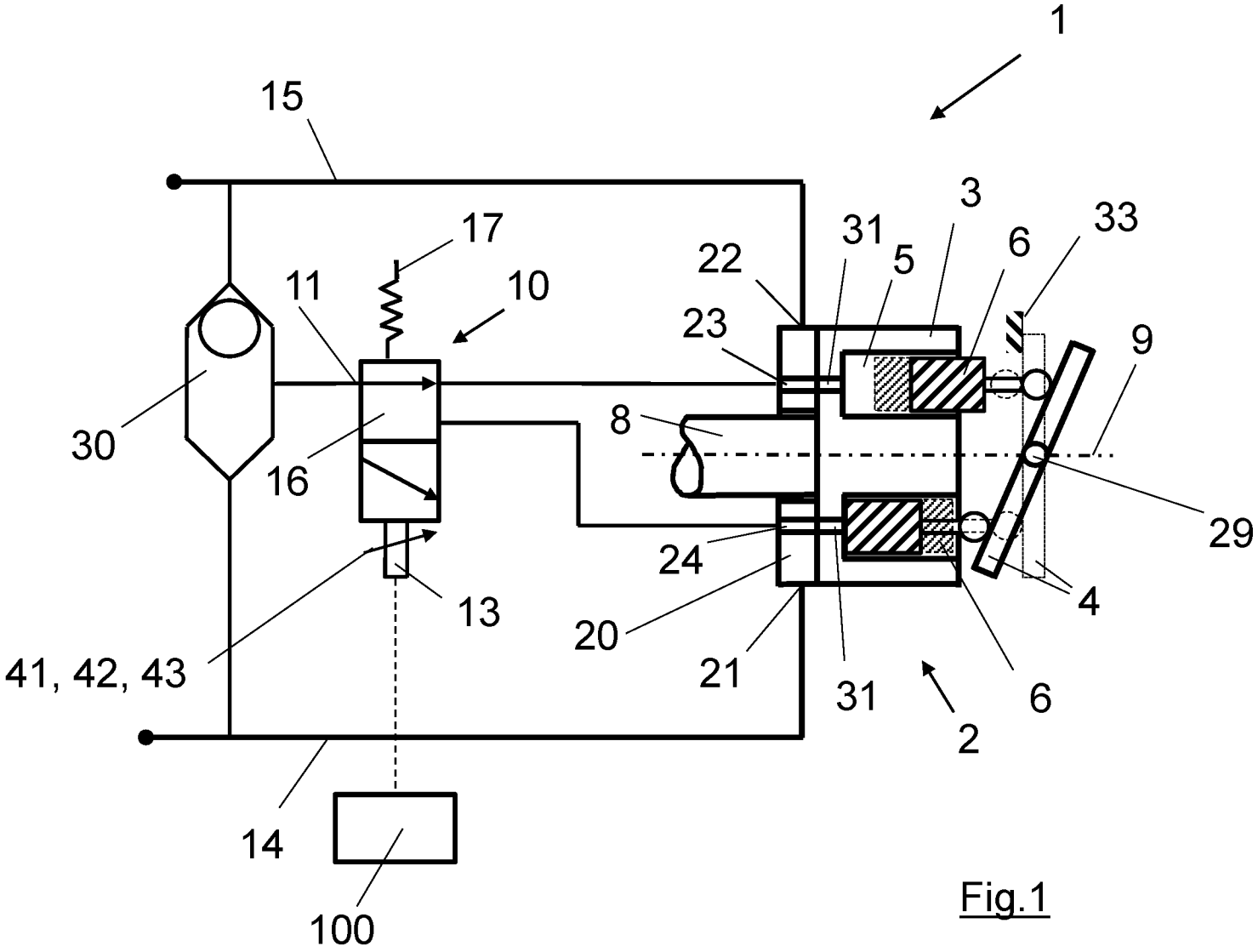
FIG. 1 schematically a first embodiment of an inventive hydraulic piston unit in a first initial position.

In the FIGS. 1 to 5, the present invention is disclosed schematically with the help of a simplified hydraulic piston unit, exemplarily a hydraulic axial piston unit of the swashplate type of construction. The shown embodiments are for simplification reasons only to show the invention in a simple manner and do not to limit the scope of the inventive idea. To the contrary, as mentioned above, the present invention is also applicable on hydraulic axial piston units of the bent axis or the tumbling plate construction type, as well as on radial piston units and vane units. Additionally, in the drawings, like reference numerals refer to like features of the hydraulic piston units of the present application. Accordingly, although certain descriptions may refer only to certain figures and reference numerals, it should be understood that such descriptions might be equally applicable to like reference numerals in other figures.

The hydraulic axial piston unit 1 shown in FIG. 1 comprises a cylinder block 3 in which cylinder bores 5 are located in general parallel to a rotational axis 9 of the cylinder block 3. Working pistons 6 can move reciprocally in these cylinder bores 5 guided by a displacement element 4 according to the invention, which is shown as an exemplary non-turning swashplate in FIG. 1. A skilled person is aware that in bent axis hydraulic axial piston units, the displacement element 4 would be a yoke bending the axis of rotation of the cylinder block with respect to a rotational axis of a drive shaft of the hydraulic axial piston unit.

In the exemplary embodiment of FIG. 1 the displacement element 4 in the form of a swashplate is tiltable around a pivot axis 29 in order to adjust the displacement volume displaced by the working pistons 6 during one revolution of the cylinder block 3. The cylinder bores 5 are fluidly connected via cylinder ports 31 and 32 with a first control port 23 and a second control port 24 on a valve segment 20 located on the lower side of the cylinder block 3, i.e. at the piston bottom side. Valve segment 20 is rotatable fixed with regard to a housing of the hydraulic piston unit and does not turn with cylinder block 3. A driving shaft 8 is attached to cylinder block 3 in a rotatably fixed manner, such that the driving shaft 8 is able to drive or to be driven by cylinder block 3 in a rotatable manner. Depending on which kidney-shaped port of the valve segment 20 forms an inlet port 21 or an outlet port 22 and in which position, i.e. in which angle of tilt the swashplate 4 is oriented, the rotational group 2 of hydraulic piston unit 1 comprising usually at least swashplate 4, working pistons 6, cylinder block 3, driving shaft 8 and valve segment 20, operates as a pump or a motor as well as operates in propel mode or in drag mode. As these details are very well known to a person of ordinary skill in the art, further explanations in this regard are omitted.

For example, the hydrostatic piston unit 1 in FIG. 1 is shown as a hydraulic piston motor in propel mode with an inlet port 21 arranged at the high pressure side 14 of the hydraulic piston unit 1. Correspondingly, outlet port 22 is arranged on the low pressure side 15. Hence, hydraulic fluid under high pressure enters the rotational group 2 at inlet port 21 and presses the working piston 6 towards the swashplate 4, which causes a rotational movement of cylinder block 3. At outlet port 22 hydraulic fluid under low pressure exits the rotational group 2 pressed by swashplate 4 via working pistons 6 and cylinder port 32—not shown in FIG. 1 as the lower working piston 6 is in its lower dead end position, in which in the simplified embodiment in FIG. 1 the cylinder port 32 is aligned with control port 24. The arrangement of the two kidney-shaped ports 21 and 22, as well as the arrangement of the inventive control ports 23 and 24 of the present disclosure, is shown exemplarily in FIG. 5. From FIG. 1 in view of FIG. 5, it may be readily understood that the cylinder block 3 of the hydraulic piston unit 1 in FIG. 1 shows an even number of cylinder bores 5, here four cylinder bores 5, which is a special configuration as frequently an odd number of cylinder bores 5 is used, for instance to enhance a smoother running of the hydraulic piston unit.

In the embodiment of FIG. 1 the swashplate 4 is pushed and held in its tilted or deflected position by hydraulic fluid under high pressure guided from a control valve 10 via first control port 23 to cylinder port 31. This provides for a sufficiently high hydraulic force in cylinder bore 5, which pushes working piston 6 to its upper dead end position and holds it there and, therefore, swashplate 4 is in the maximum deflected/tilted position, as shown in FIG. 1. The hydraulic fluid under high pressure enters the control valve 10 via a high pressure port 11 which is fluidly connected via a high pressure selecting valve 30 to the high pressure side 14. Exemplarily, high pressure selecting valve 30 may be designed as double check valve connected to both pressure sides of the hydraulic piston unit 1.

In the operational state of the hydraulic piston motor 1 according to FIG. 1, control valve 10 with its control valve spool 16 is in a first (initial) position in which control valve 16 conducts hydraulic fluid under high pressure to the first control port 23. Control valve spool 16 is held in this first initial position by means of a control valve spring 17. An actuator 13 is arranged on the opposite side of control valve spool 16, the actuator 13 is controlled by a suitable control unit 100 and is configured to generate a counter force against the elastic force of control valve spring 17 in order to move the control valve spool 16 into a second shifted position. The actuator 13 may be, for example, an electro-mechanical actuator 41, a hydraulic actuator 42, a pneumatic actuator 43 or a combination thereof. In this second shifted position control valve spool 16 is capable of conducting hydraulic fluid under high pressure to the second control port 24, thereby changing the angle of tilt of swashplate 4, as hydraulic fluid under high pressure enters cylinder bore 5 via cylinder port 32 and presses working piston 6 towards the swashplate 4. By this change of the tilt angle of swashplate 4, the stroke of all working pistons 6 is changed and thereby the displacement volume of hydraulic piston unit 1 is also changed. Even though the displacement volume of hydraulic piston unit 1 is changed, the high pressure selecting valve 30 remains in the same position as long as the high-pressure side 14 and low-pressure side 15 do not swap, such that side 15 becomes the high-pressure side and side 14 becomes the low-pressure side.

A switched position of control valve 10 is shown in FIG. 1 with dashed lines, in which the swashplate 4 is at zero position abutting against a stop 33, i.e. the angle of tilt is equal to zero. In this operational condition, the hydraulic piston unit 1 does not show a displacement volume as the swashplate is oriented perpendicular to the rotational axis 9, which means that the working pistons do not perform any stroke as the distance between swashplate and cylinder block seen in direction of the rotational axis is not varying in circumferential direction. Thus, in this state the hydraulic piston unit idles without performing any work.

However, it should be readily understood that the swashplate 4, rather than abutting against stop 33, may instead be tilted to negative angles with respect to the position of FIG. 1, i.e. a deflection of the swashplate 4 contrary to the situation shown in FIG. 1. This would be, for instance, a setting when the hydraulic motor of FIG. 1 would be operated in drag mode, now working as a pump and, for instance, performing a break effect on a hydraulic propel application.

Figure 2:
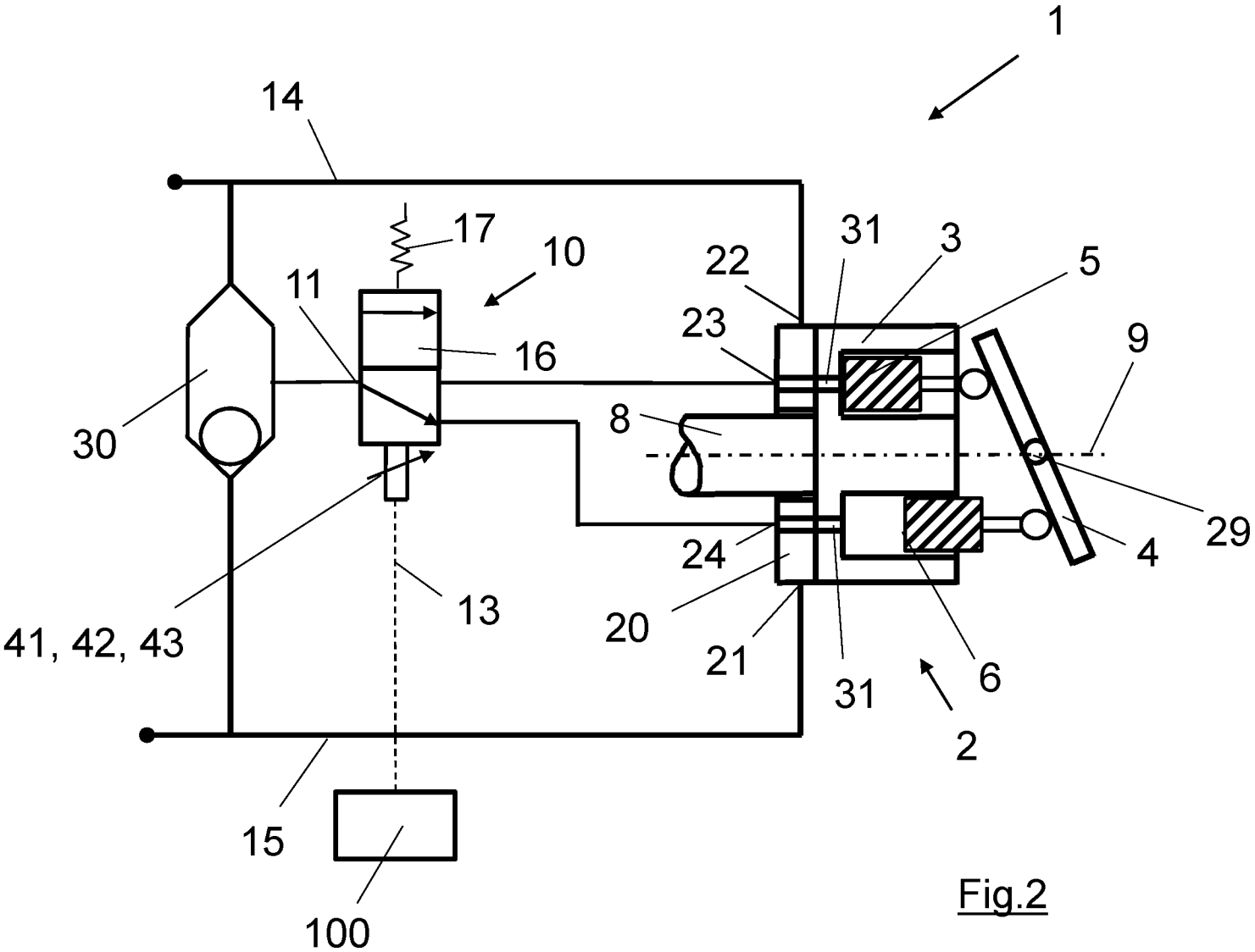
FIG. 2 schematically a second embodiment of the inventive hydraulic piston unit with a control valve spool in shifted position.

FIG. 2 schematically shows a second embodiment of the inventive hydraulic piston unit with the control valve spool 16 in shifted position. Differing from the embodiment of FIG. 1, the high-pressure side 14 is changed with the low-pressure side 15 in FIG. 2. Assuming that the conveying direction is the same as for the embodiment of FIG. 1, i.e. counter clock-wise, the hydraulic piston unit 1 works as a pump, wherein the pressure present at control port 24 determines the angle of tilt of the swashplate 4 and therewith the displacement volume of the hydraulic piston unit 1, here a hydraulic axial piston pump.

Figure 3:
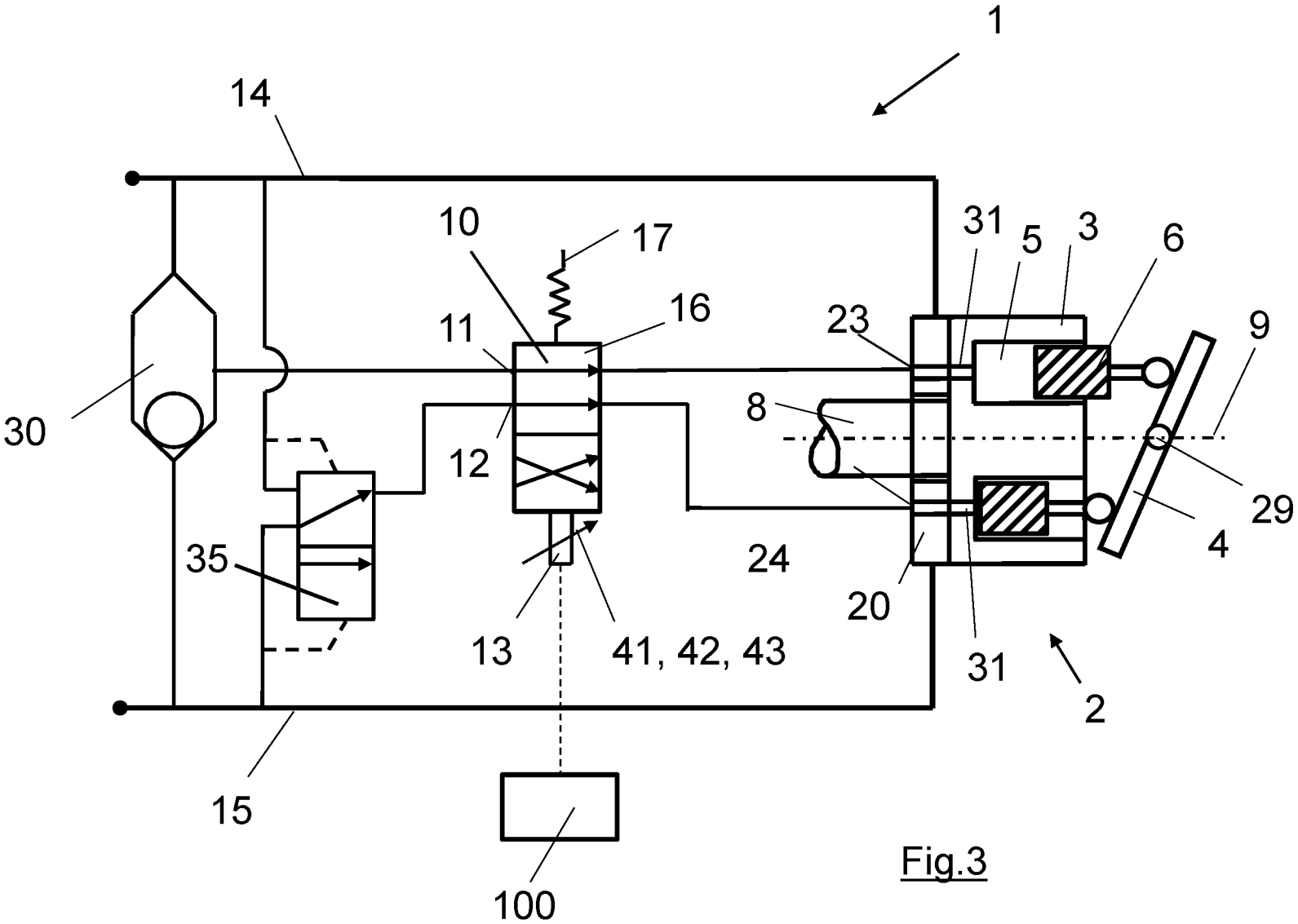
FIG. 3 schematically a third embodiment of the inventive hydraulic piston unit in a first initial position.

FIG. 3 shows another embodiment of the inventive hydraulic piston unit 1, which differs from the embodiments of FIGS. 1 and 2 in that control valve 10 is a 4-way/2-position valve guiding hydraulic fluid under high pressure to control port 23 and hydraulic fluid under low pressure to the respective other control port 24. This configuration provides for a better lubrication effect at the lower dead end region of the working pistons 6 on the valve segment 20. In order to provide hydraulic fluid under low pressure from the low-pressure side to control valve 10, a low pressure selecting valve 35 is arranged upstream the control valve 10. Low pressure selecting valve 35 is connected to the high pressure side 14 as well as to the low pressure side 15. Thereby the valve spool of low pressure selecting valve 35, e.g. a 3-way/2-position valve is referenced on one front side to high pressure side and on the opposite side to low pressure to ensure that it is always the low pressure side which is connected to a low pressure port 12 of control valve 10. Analogous to the embodiments of FIGS. 1 and 2 a high pressure selecting valve 30 ensures that high pressure port 11 of control valve 10 is connected to the high pressure side 14 of hydraulic piston unit 1.

As can be seen from FIG. 3 the angle of tilt of the swashplate 4 can be changed to the other side, i.e. the leading sign of the angle can be changed from to the respective maximum values in each direction. By doing this, the direction of conveying can be changed, with which the high-pressure side interchanges with the low-pressure side, yet the rotational direction of the hydraulic piston unit 1 remains the same. Additionally, when the conveying direction is maintained, shifting the control valve spool 16 from one position to the other switches the hydraulic piston unit 1 from pump mode to motor mode, and vice versa, as it is preferred for a propel application when changing from propel mode to drag mode. This switched configuration is shown, for example, in FIG. 4.

Figure 4:
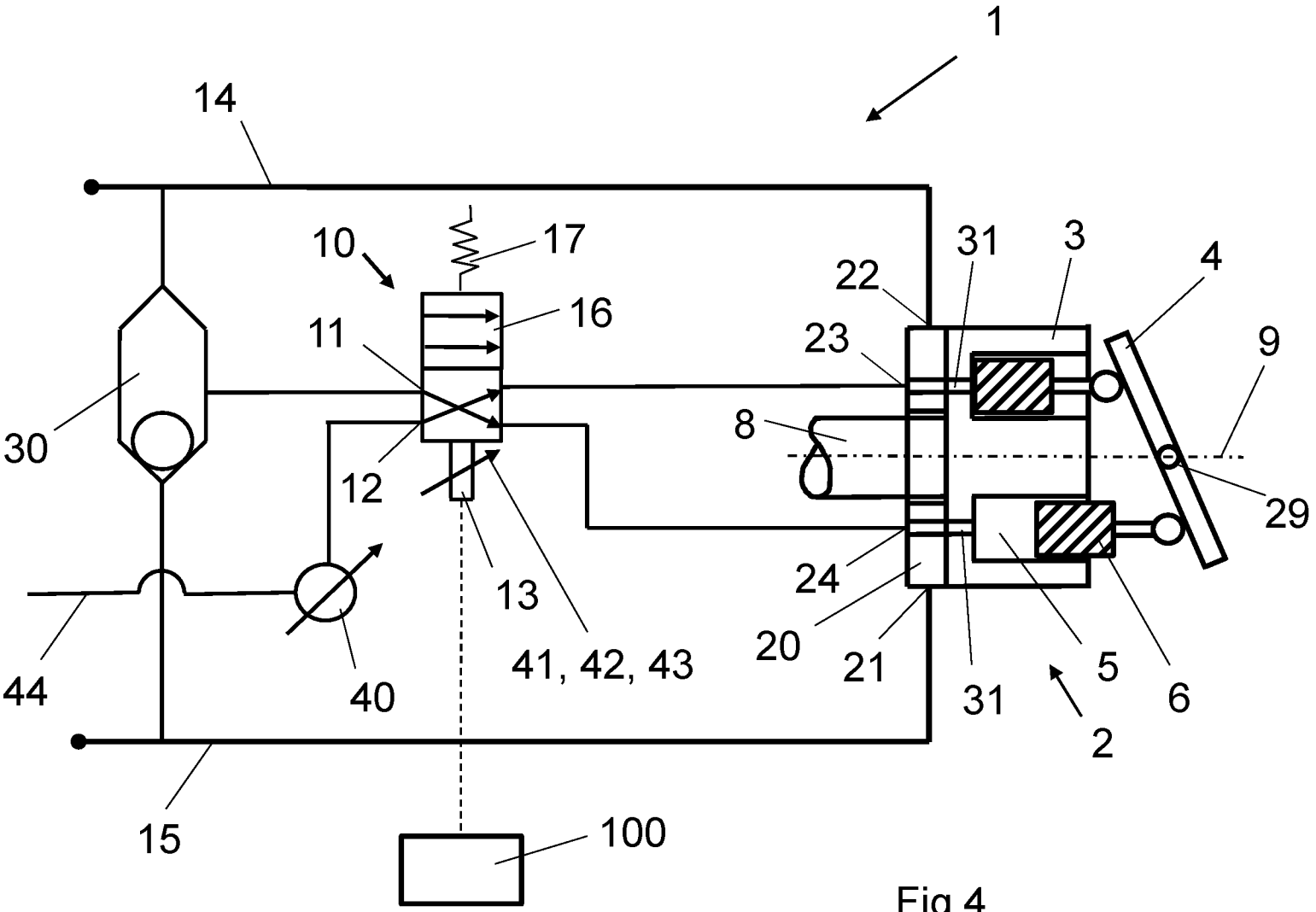
FIG. 4 schematically the embodiment of FIG. 3 with the control valve spool in shifted position.
Figure 5:
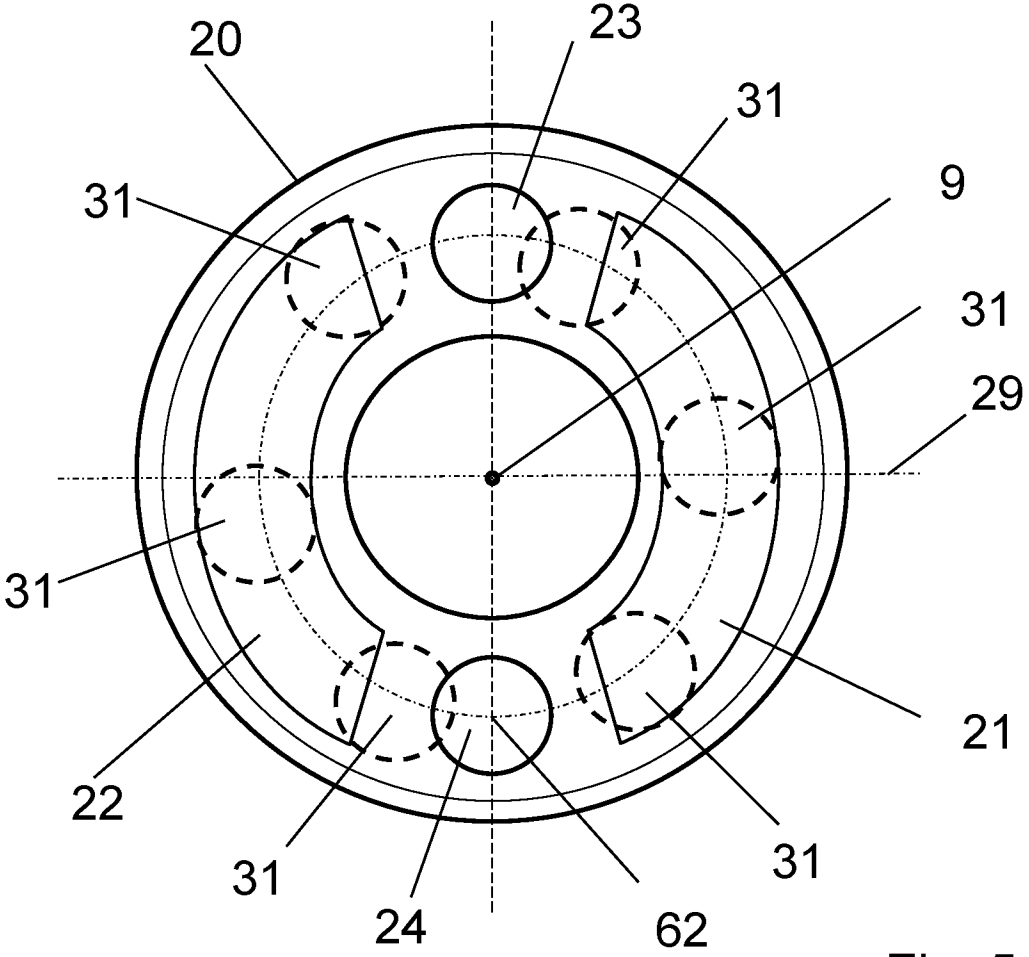
FIG. 5 schematically a valve plate adapted according to the invention.

Additionally FIG. 4 shows another embodiment of the inventive hydraulic piston unit 1, where the hydraulic fluid under a lower pressure than the high pressure is provided for instance by a charge pressure source 40. This enables the preselection of an operational mode at standstill of the hydraulic piston unit 1. For instance, the conveying direction in the case of a hydraulic pump may be selected, simply by shifting the control valve spool 16 in the appropriate position. It should be readily understood that this charge pressure source 40 is interchangeable with any system pressure source 44 providing hydraulic fluid under a lower pressure lower than the pressure at the high pressure side of hydraulic piston unit 1. Furthermore, the pressurized hydraulic fluid guided to one of control ports 23 or 24 improves the lubrication situation on the low pressure area of valve segment 20. As shown in FIG. 5 control ports 23 and 24 are arranged between the kidney-shaped inlet and outlet port 21 and 22 at the respective dead end positions 61 and 62 of the working pistons 6. The circumferential distance between the borders of the kidney-shaped ports 21 and 22 and the borders of the control ports 23 and 24 is preferably less than the double circumferential distance between the borders of the cylinder ports 31. By doing this it can be assured that, in particular with an odd number of cylinder bores, always one cylinder port 31, 32 overlaps with at least one control port 23, 24 to ensure better and quicker reacting control as well as a smother run of the hydraulic piston unit 1.

In summary, with the inventive hydraulic piston unit of the present disclosure, a smaller hydraulic piston unit with a reliable displacement volume control is provided, which eliminates the need of a (external) servo unit. This not only saves costs but also renders the hydraulic piston unit less complex and more reliable as it comprises fewer parts. Also leakage is reduced significantly as less parts are subjected to hydraulic pressure.

The invention claimed is:

1. A Hydraulic piston unit comprising:

a rotational group for driving or being driven by a driving shaft, the rotational group comprising a cylinder block with cylinder bores and pistons mounted to be reciprocally moveable in the cylinder bores for conveying hydraulic fluid from a kidney-shaped inlet port to a kidney-shaped outlet port of a valve segment, a displacement element being tiltable with respect to a rotational axis of the driving shaft between a first end position and a second end position for adjusting a displacement volume of the rotational group between a minimum or a maximum displacement, wherein, on the valve segment between the inlet port and the outlet port at respective dead end positions of the reciprocally moveable working pistons, a first control port and a second control port are located in fluid connection with the cylinder bores for controlling the position of the displacement element, wherein the hydraulic piston unit further comprises a control valve with a shiftable control valve spool, the shiftable control valve spool being a two-position valve being shiftable by means of an actuator between only an initial position and a shifted position, the control valve being fluidly connected via a high pressure port to the high pressure side of the hydraulic piston unit being capable to conduct hydraulic fluid from the high pressure side to one of the first and the second control port, wherein, in the initial position, the control valve is configured to conduct the hydraulic fluid under high pressure to the first control port in order to adjust the displacement element to be maintained at the first end position for maintaining the displacement volume at one of the minimum or the maximum displacement and, in the shifted position, the control valve is configured to conduct the hydraulic fluid from the high pressure port to the second control port in order to adjust the position of the displacement element to be maintained at the second end position for maintaining the displacement volume at the other of the minimum or the maximum displacement, wherein the actuator is an electro-mechanical actuator that is controllable by a control unit; and wherein the actuator is configured to shift the control valve spool when a predetermined system parameter is exceeded or underrun.

2. The hydraulic piston unit according to claim 1, wherein the control valve spool is held by a control valve spring in the initial position, in which hydraulic fluid under high pressure can be conducted to the first control port in order to adjust the displacement element into the first end position.

3. The hydraulic piston unit according to claim 2, wherein the hydraulic piston unit is a hydraulic piston unit of the two position construction type.

4. The hydraulic piston unit according to claim 1, wherein the displacement element is held in an initial position by an elastic force generated by a spring.

5. The hydraulic piston unit according to claim 2, further comprising a high pressure selecting valve fluidly connected to both pressure sides of the hydraulic piston unit for supplying hydraulic fluid from the high pressure side to the high-pressure port of the control valve.

6. The hydraulic piston unit according to claim 5, further comprising a low pressure selecting valve fluidly connected to both pressure sides of the hydraulic piston unit for supplying hydraulic fluid from the low pressure side to a low-pressure port of the control valve, wherein the control valve spool is configured to conduct hydraulic fluid under low pressure to the respective other control port of the first and second control port that is not charged by high pressure.

7. Hydraulic piston unit according to claim 1, wherein the control valve further comprises a low pressure port fluidly connected to a charge pressure source of the hydraulic piston unit or to any other system pressure line, wherein the control valve spool is configured to conduct hydraulic fluid under charge pressure or system pressure to the respective other control port of the first and second control port that is not charged by high pressure.

8. The hydraulic piston unit according to claim 1, wherein the hydraulic piston unit is a hydraulic piston unit of the two position construction type.

9. The hydraulic piston unit according to claim 1, further comprising a high pressure selecting valve fluidly connected to both pressure sides of the hydraulic piston unit for supplying hydraulic fluid from the high pressure side to the high-pressure port of the control valve.

10. The hydraulic piston unit according to claim 1, further comprising a low pressure selecting valve fluidly connected to both pressure sides of the hydraulic piston unit for supplying hydraulic fluid from the low pressure side to a low-pressure port of the control valve, wherein the control valve spool is configured to conduct hydraulic fluid under low pressure to the respective other control port of the first and second control port that is not charged by high-pressure.

11. A method for controlling the displacement volume of a rotational group of a hydraulic piston unit comprising a control valve with a two-position shiftable control valve spool shiftable between only an initial position and a shifted position, the control valve being fluidly connected via a high pressure port to the high pressure side of the hydraulic piston unit, and a valve segment with a first control port and a second control port located on the valve segment at respective dead end positions of working pistons reciprocally moveable in cylinder bores of a cylinder block of the rotational group, the method comprising:

holding the control valve spool in its initial position to conduct hydraulic fluid from the high pressure side via the control valve to one of the first or second control port, when an initial displacement volume of the rotational group is being maintained, and shifting the control valve spool to the shifted position and holding the control valve spool in the shifted position by means of an actuator for conducting hydraulic fluid under high pressure via the high-pressure port to the respective other control port of the first or second control port, when the displacement volume of the rotational group is to be changed and maintained at a maximum displacement volume, the actuator being an electro-mechanical actuator, wherein shifting the control valve spool includes commanding the actuator via a control unit; and wherein controlling system parameters by means of the control unit and shifting the control valve spool by commanding the actuator via the control unit in case one system parameter is exceeded or underrun.

12. The method according to claim 11, wherein the control valve further comprises a low pressure port and the control valve spool conducts hydraulic fluid from the low pressure side to the respective other one of the first or second control port that is not charged with high pressure.

13. The method according to claim 11, wherein the control valve further comprises a low pressure port and the control valve spool conducts hydraulic fluid from the low pressure side to the respective other one of the first or second control port that is not charged with high pressure.

* * * * *